United States Patent [19]

Heng et al.

[11] Patent Number: 4,729,738

[45] Date of Patent: Mar. 8, 1988

[54] INSULATION-PIERCING CONNECTION ARRANGEMENT FOR AN ELECTRIC WIRE

[75] Inventors: Jean-Paul Heng, Lyon; André Marmonier, Bron; Noël Revollon, Decines Charpieu; Ariel Ruiz, Villeurbanne, all of France

[73] Assignee: CGEE Alsthom, Levallois-Perret, France

[21] Appl. No.: 41,038

[22] Filed: Apr. 22, 1987

[30] Foreign Application Priority Data

Apr. 28, 1986 [FR] France ..... 86 06124

[51] Int. Cl.[4] ..... H01R 4/24

[52] U.S. Cl. ..... 439/395; 439/409

[58] Field of Search ..... 439/391, 395, 409, 410, 439/432

[56] References Cited

U.S. PATENT DOCUMENTS

| | | | |
|---|---|---|---|
| 4,340,270 | 7/1982 | Wilmes et al. | 439/409 |
| 4,466,682 | 8/1984 | Jusseau et al. | 439/391 |
| 4,541,679 | 9/1985 | Fiedler et al. | 439/395 |

FOREIGN PATENT DOCUMENTS

| | | | |
|---|---|---|---|
| 2516711 | 5/1983 | France | 439/391 |
| 2158303 | 11/1985 | United Kingdom . | |

OTHER PUBLICATIONS

Pt/Electrotechniek Elektronica, vol. 40, Apr. 4, 1985, pp. 37–38, Lumberg.

*Primary Examiner*—John McQuade

*Attorney, Agent, or Firm*—Sughrue, Mion, Zinn, Macpeak, and Seas

[57] ABSTRACT

An insulation-piercing connection arrangement for an electric wire in which an auxiliary insertion part (4) is displaced by a removable shank (5) acting as a lever in order to apply the necessary pressure for slicing through the insulating covering (20) of an electric wire (2) to be connected, and to insert the core (21) of said wire in a slit. The auxiliary insertion part (4) has a shank-receiving duct passing therethrough and includes a pusher (40) for pressing against the wire to be connected, it also includes a guide device (43) including wheels which co-operate with guide grooves (73) provided in the housing (7) containing the connection arrangement in order to enable the auxiliary insertion part (4) to perform pseudocircular insertion motion, thereby accelerating the tilting thereof when it is displaced between its two extreme positions.

7 Claims, 7 Drawing Figures

INSULATION-PIERCING CONNECTION ARRANGEMENT FOR AN ELECTRIC WIRE

The present invention relates to a connection arrangement of the type having an insulation-piercing slit for electrically connecting and mechanically retaining at least one insulated electric wire, and without requiring the wire to be prior stripped.

BACKGROUND OF THE INVENTION

Such connection arrangements are conventionally implemented to interconnect wires, for example in terminal block type devices, or to connect wires to electrical equipment such as a control unit.

Conventionally, each connection arrangement includes an insulation-piercing slit provided in a thin conductive part. At one of its ends, the slit has a flared inlet in order to facilitate longitudinal insertion of the wire to be connected into the slit, which wire is disposed transversely relative thereto, and simultaneously at the beginning of insertion to slice through the insulation in which the wire is covered.

The core of the wire whose insulation has locally been pierced at the inlet comes into contact with the edges of the slit which retain it mechanically by applying pressure thereto and which simultaneously provide electrical continuity between the wire and the conductive part.

An electric wire is advantageously inserted into an insulation-piercing slit by means of an auxiliary part which is incorporated in the block or in the equipment and which forces the wire into the slit via its insulation-piercing opening. For reasons of convenience and efficiency, the auxiliary insertion part is often pushed by means of a tool which provides a better grip and which may also provide a mechanical advantage in order to facilitate connection operations.

However, the way in which connection arrangements are positioned in their operating environment does not always allow for a tool to be received and manipulated properly, in particular because of the concentration of and the overlap between members or equipment which include said connection arrangements, or because of the profusion of wires surrounding them. As a consequence, the present invention proposes an insulation-piercing connection arrangement for an electric wire including an annular wire insertion part operable by the lever effect, which arrangement is simple, easy to manipulate, and occupies little volume in the block or the equipment in which it is incorporated.

SUMMARY OF THE INVENTION

The present invention provides an insulation-piercing connection arrangement for an electric wire, the arrangement comprising:

a conductive part having a slit having parallel edges and provided with an insulation-piercing inlet;

an insulating housing in which said conductive part is received, said housing being provided with a wire-passing opening for passing a wire parallel to the insulation-piercing slit, and with a shank-passing opening for passing a removable shank forming a lever for operating the connection arrangement;

an auxiliary wire-insertion part received in said housing and operable by said removable shank to press against one end of an electric wire to be connected in the slit, in such a manner that said wire end passes through said insulation-piercing inlet into said slit in a direction transverse to said wire until it occupies a position where the core of the wire is retained between the edges of the slit in electrical connection with said conductive part;

the arrangement including the improvements whereby;

said auxiliary insertion part is provided with an operating body having a shank-passing duct passing therethrough and said housing supports a fixed hole suitable for engaging a leading end of said removable shank when received in said shank-passing duct and acting as a thrust point therefor;

said auxiliary insertion part carries a pusher for pushing against said wire; and said housing and said auxiliary insertion part include an insertion part guide device comprising wheels disposed on said insertion part to co-operate with two complementary guide grooves in the housing in such a manner as to impart pseudocircular motion to said auxiliary insertion part under lateral pressure from said shank passing through said duct and pressing into said fixed hole;

thereby enabling said pusher to alternate, when a wire is connected by means of said arrangement, between an inclined, "admission", position in which said pusher allows an electric wire to be admitted through said orifice over said insulation-piercing inlet, and an "insertion" position in which a pushing end of said pusher moves to beneath the level of said insulation-piercing inlet while pushing against said wire whose core is thus clamped between said parallel edges of said slit.

BRIEF DESCRIPTION OF THE DRAWINGS

An embodiment of the invention is described, by way of example, with reference to the accompanying drawings, in which.

MORE DETAILED DESCRIPTION

Figure 1:
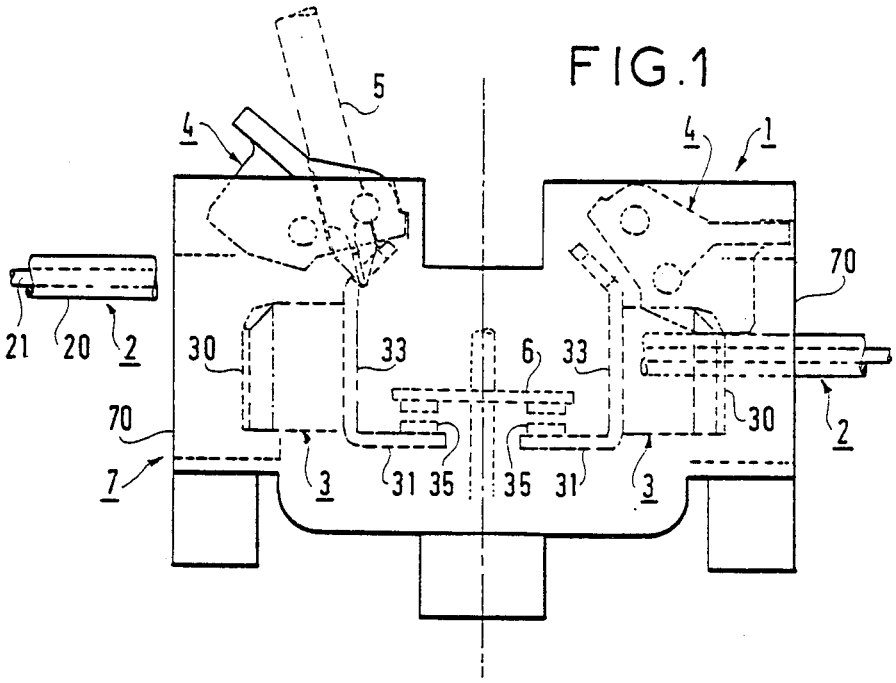
FIG. 1 is a diagrammatic view of electrical equipment fitted with a connection arrangement in accordance with the invention.

The connection arrangement in accordance with the invention is intended to be fitted to a unit of electrical equipment for providing connection between said unit and one or more wires in parallel, and in the non-limiting example of FIG. 1 the unit is shown as electrical equipment 1 of the junction block or control member type, with its essential internal components being drawn in dashed lines.

Figure 5:
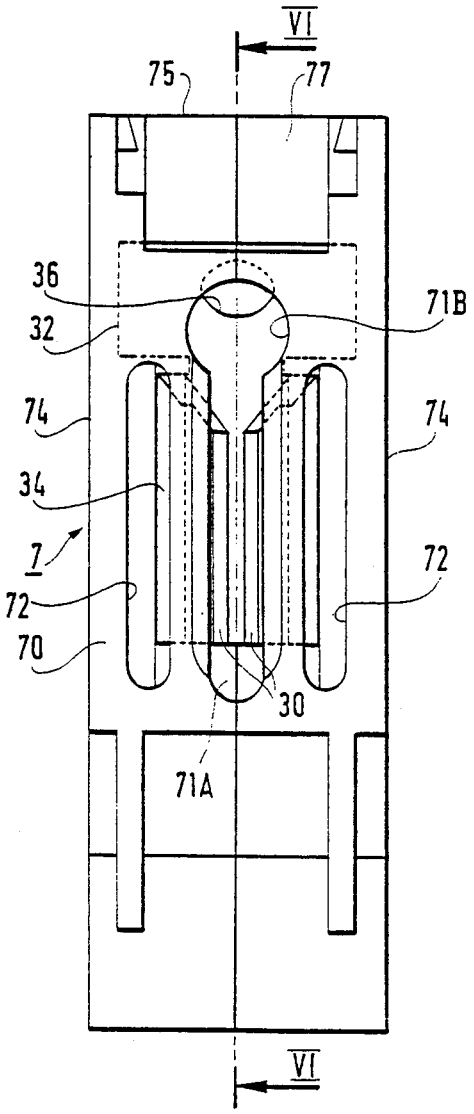
FIG. 5 is a side view of the block shown in FIG. 1 with the auxiliary part removed.
Figure 6:
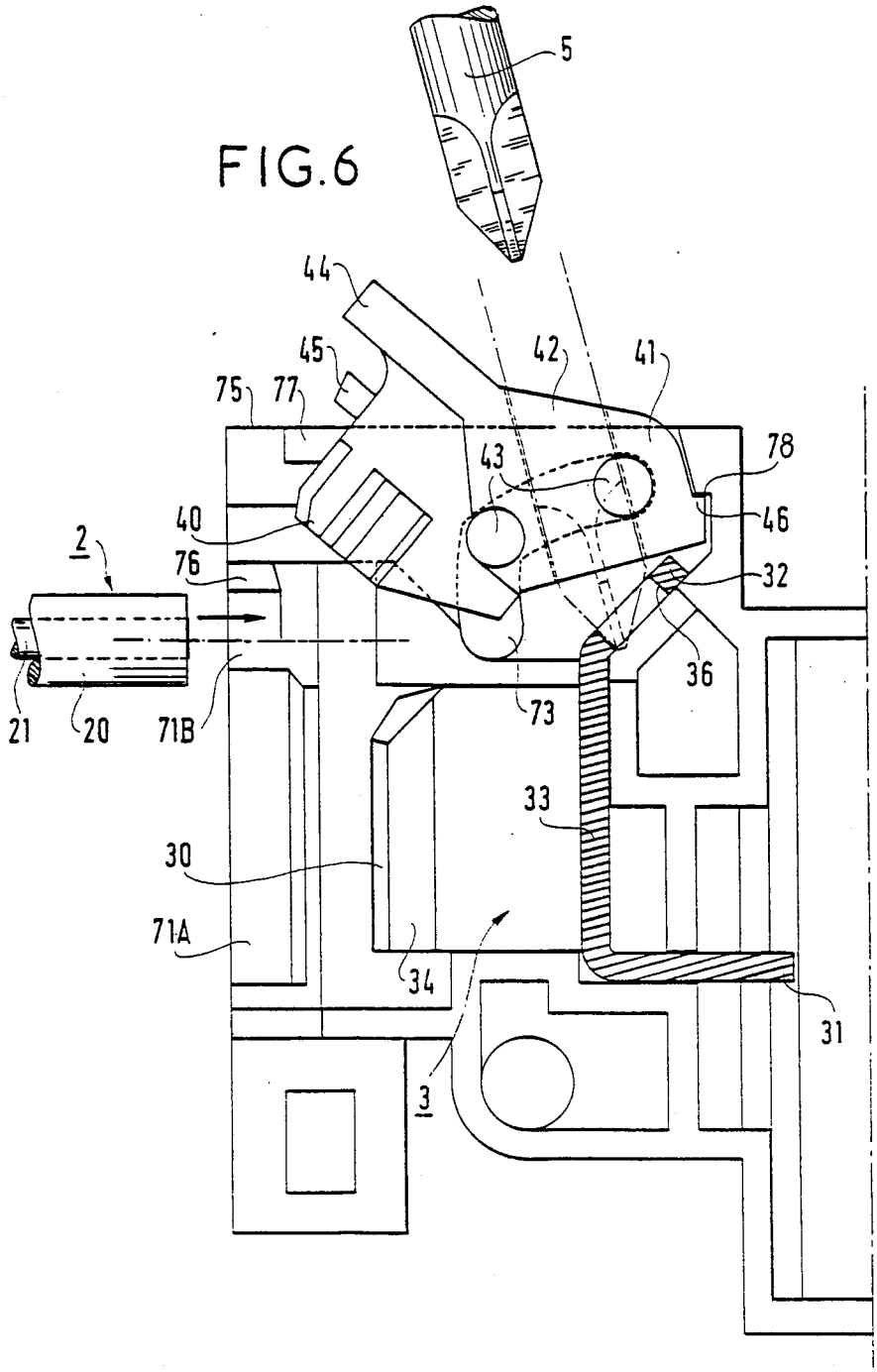
FIGS. 6 and 7 are two fragmentary sections showing the connection arrangement in accordance with the invention respectively before and after connection to a wire with the aid of a shank of a tool.
Figure 7:
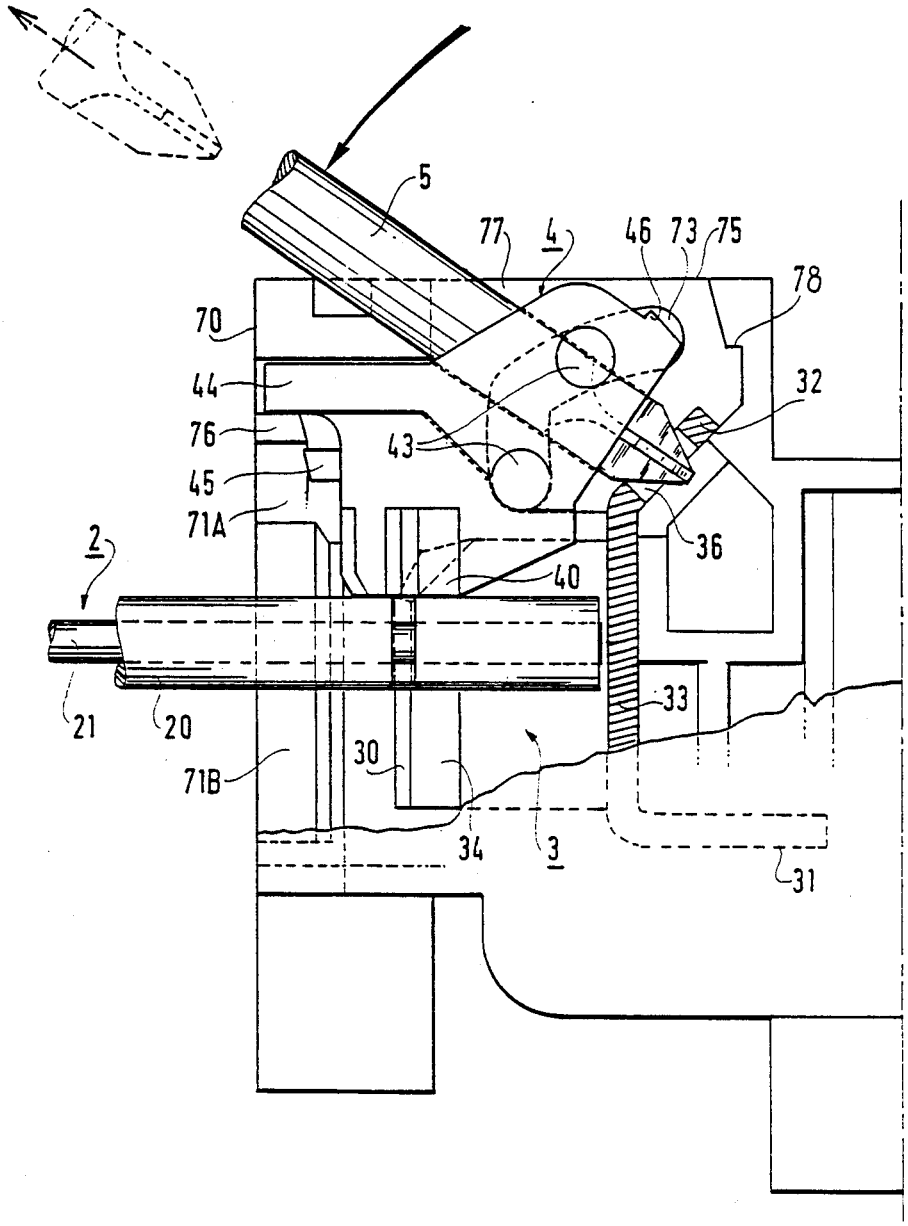

Such electrical equipment serves to interconnect two electric wires 2 by means of at least one (and in this case two) identical connection arrangements, which, more precisely, are identical to that shown in FIGS. 5 to 7.

Each connection arrangement comprises a conductive part 3 having an insulation-piercing slit suitable for making a connection with at least one electric wire 2, together with an auxiliary wire insertion part 4 which is movable under the action of an independent shank 5 acting as a lever when a wire is inserted.

In the embodiment shown in FIG. 1, the electric equipment 11 includes two connection arrangements each suitable for connecting at least one electric wire 2 in a conductive part 3, and the two conductive parts 3 are capable of being put into electrical connection by means of a conventional contactor member 6 which is not described in greater detail since it is only indirectly related to the invention.

The connection arrangements and the contactor 6 are conventionally received in a housing 7 of insulating material which in this case is constituted by two symmetrical half-shells which are assembled, for example, by ultrasonic welding along a join plane on line VI—VI of the block as shown in FIG. 5.

The housing 7 is generally rectangular in shape and is conventionally provided with fixing means (not shown) at the bottom thereof, said means enabling it to be fixed, for example, to a section bar, said fixing being achieved, for example, by means analogous to those provided for a terminal block described in French Pat. No. 2 503 464.

Each conductive part 3 is a metal part (see FIG. 5) including an elongate slit delimited by two edges 30 which are parallel over the major portion of their length with the exception of at least one of the ends of the slit where said edges are flared in order to constitute an inlet intended to facilitate insertion of an electric wire 2 into the slit and to slice through the insulating covering 20 thereof.

In the embodiment described herein (see FIG. 6) the connection piece 3 is made by folding a blank and it includes a tubular portion along which the slit delimited by the edges 30 extends, together with two extensions 31 and 32 disposed on either end of a plane end wall 33 of the tubular portion and extending away from said portion and folded in a manner described below.

The end wall 33 has two parallel side walls which are perpendicular thereto and each of which is extended by a sloping wall 34 whose outermost longitudinal margin constitutes one of the edges 30 of the slot, said side walls delimiting the tubular portion of the connection part and forming a spring clamp having a roughly C-shaped section with the edges 30 constituting its jaws and suitable for clamping resiliently against the conductive core(s) 21 of one or more electric wires 2. One of the extensions referenced 31 is folded away from the tubular portion of the conductive part 3 perpendicularly, in this case, to the end wall 33 of said conductive part, and is designed, in this case, to receive a contact tab 35 forming a part of the contactor 6 as can be seen in FIG. 1.

The other extension, referenced 32, has a hole 36 therethrough for enabling the tip on the shank 5 of a tool to pass therethrough, said tool being a screwdriver with a cross-shaped blade, for example. In the embodiment shown, the extension 32 is tilted backwardly e.g. at 45° from its initial position of alignment with the end wall 33, thereby going away from the tubular portion.

In the example shown in FIG. 1, the two conductive parts 3 are identical and are disposed symmetrically on either side of the transverse and longitudinal mid-planes of the housing 7 in which they are contained, with their first extensions 31 being aligned and pointing towards each other so that the insulation-piercing slits that they include point towards the small sides 70 of said housing 7 (i.e. the vertical sides in FIG. 1).

As mentioned above, the edges 30 delimiting the slit of one of the conductive parts 3 are flared to form an inlet at one of the ends of the slit, which slit runs longitudinally through the tubular portion of the conductive part parallel to its end wall 33 and to the longitudinal mid-axis of said end wall.

In the embodiment chosen, the inlet flares towards the second extension 32.

As already shown, the inlet is intended firstly to guide the wires 2 for connection in the slit and secondly to slice through the insulation of said wires so as to uncover the cores thereof in order to establish electrical continuity between the wire cores and the conductive part which clamps the wire(s) between the edges of its slit, once each corresponding wire has been forced into said slit 30 through its inlet.

In conventional manner, as shown in FIG. 5, each of the small sides 70 is provided with a wire-passing opening 71 extending parallel to the edges of the slit 30 in the adjacent conductive part 3. The wire-passing opening 71 includes a slot 71A running along the entire length of the edges of the slit 30 and intended to retain the insulating covering 20 of any electric wire 2 whose core 21 is clamped between the edges of the slit 30, this slot is therefore narrower than the expected diameters of the insulating coverings.

The wire-passing opening 71 also includes an orifice 71B for wire admission, said orifice opening out sideways into the slot above its flared inlet so as to enable a wire 2 to be admitted perpendicularly to the end wall 33 of the conductive part 3 through the corresponding small side 70. Naturally, this orifice 71B is large enough to enable wires to be admitted without force until they come into abutment against the end wall 33.

In the embodiment shown in FIG. 5, there are two slots 72 on either side of the wire-passing opening 71 and extending parallel to its slot 71A, thereby enabling the sides of the slot 71A to deform without overall deformation of the housing 70.

In the example shown in FIG. 1, the two auxiliary insertion parts 4 are identical and are capable of occupying symmetrical positions both relative to the longitudinal midplane and relative to the transverse mid-plane of the housing 70 in which they are contained.

Figure 2:
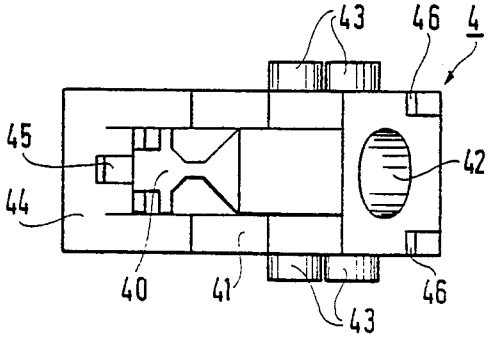
FIGS. 2, 3, and 4 are three views of an auxiliary insertion part for a connection arrangement in accordance with the invention, FIG. 2 being a plan view, FIG. 4 being a front view and FIG. 3 being a left-hand view.
Figure 3:
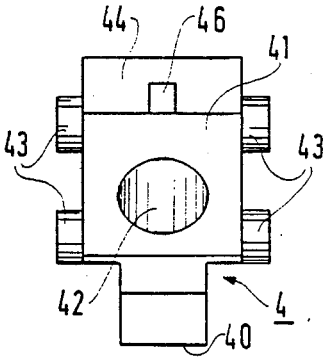
Figure 4:
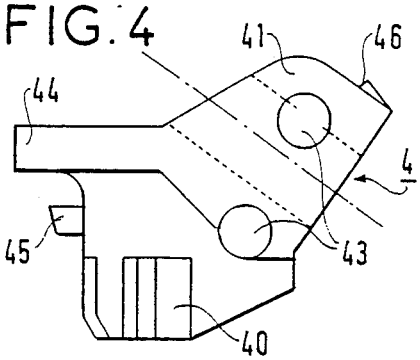

Each auxiliary insertion part 4 is essentially constituted (see FIGS. 2 to 4) by a pusher 40 for pressing against a wire to be inserted, an operating body 41 on which the pusher is mounted and having a duct 42 passing therethrough to receive the shank 5, and a guide device 43 which is constituted, in this case, by two pairs of aligned wheels disposed on the operating body on either side of the pusher.

In accordance with the invention, each auxiliary insertion part 4 which is capable of moving to enable a wire to be admitted through an orifice 71 above the flared inlet to the associated conductive part 3 and also to insert said wire into the insulation-piercing slit of said conductive part, is arranged and mounted in such a manner as to enable the admission and the insertion of the wire by small-amplitude displacement of the shank which is used as a lever, while nevertheless allowing the pusher to move sufficiently to enable the wire to be admitted over the flared inlet to the conductive part and to enable said wire to be inserted into the slit, with the auxiliary insertion part requiring only a small volume in the housing for displacement purposes.

To this end, the wheels on the guide device 43 are received in two complementary guide grooves 73 which are identically provided in the inside walls of the two large parallel sides 74 of the housing 70 and close to the ends 75 thereof.

In the example shown, each guide groove 73 is provided above the location in which the tubular portion of a conductive part 3 is fixed in the housing 7, and it is formed by two distinct successive zones.

A first zone of the guide groove 73 (see FIGS. 6 and 7) is slightly curved and is directed at least approximately parallel to the insulation-piercing slit of the conductive part 3 disposed therebeneath in the housing 7, and practically halfway between said slit and the end wall 33 of the conductive part 3.

A second zone of the guide groove which opens out into the first zone is at a considerable slope and points in a direction close to that of the second extension 32 of the conductive part 3 over which it is installed, and moves closer towards said extension at their respective ends. In the embodiment shown where the second extension is at an angle of 45° to the end wall 33, and thus to the slit, the second zone of the groove has its longitudinal axis at a slope of about 70°, thereby enabling the block to have a relatively small height for receiving the auxiliary insertion part 4 and providing accelerated tilting of the auxiliary part.

On either side of the guide device 43 of an auxiliary insertion part, the two wheels are received in different zones of the guide groove 73 which they share, and the auxiliary insertion part is subjected to pseudo-rotation which causes its pusher 40 to be tilted from an inclined or "admission end" position in which one of the wheels is at the end of the second zone of the groove and in which the orifice 71B is completely disengaged of any obstruction by the pusher 40 of the auxiliary insertion part concerned (FIG. 6), to an "insertion" position in which the pusher is located behind the orifice 71B perpendicular to the the insulation-piercing slit and level with the zone where the parallel edges of the slit flare apart in order to constitute the insulation-piercing inlet.

Thus, as can be seen in FIGS. 6 and 7, the wheels of the guide device 43 are aligned and slide in the first zones of the two complementary guide grooves 73 which are preferably positioned between the pusher 40 and the duct 42 for passing the removable shank.

In the embodiment shown, each auxiliary insertion part 4 is provided with an abutment 44 which presses against a counter-abutment 76 of the housing 70 at the end of its stroke when the end of the pusher is level with the bottom of the insulation-piercing inlet.

In addition, there is an index 45 which is located, in this case beneath the abutment, and which is constituted by a small rod molded with the auxiliary insertion part and disposed in such a manner as to be visible through the orifice 71B of the housing when the auxiliary insertion part is pressed against the counter-abutment.

The duct 42 provided through each auxiliary insertion part 4 is disposed at an angle relative to the pusher 40 in such a manner that its orifice opening out in the vicinity of the second extension 32 of the corresponding conductive part 3 is always opposite the hole 36 provided in said second extension 32 in order to receive the pointed tip of the shank 5, regardless of the position of the auxiliary insertion part 4 in the housing 7.

The duct 42 opens out via a second orifice above the abutment 44 and level with an opening 77 through the top portion 75 of the block to enable the shank 5 to be admitted into the block and to enable it to be tilted through an angle while the auxiliary insertion part 4 is being moved inside the housing 4.

In conventional manner, the auxiliary insertion part(s) 4 and the conductive part(s) 3 are enclosed in the electrical equipment housing when the electrical equipment is made Each auxiliary part 4 is positioned in the open position prior to admission of an electric wire 2 so that the orifice 71B is unencumbered, and it is held in this position by a catch 46 mounted thereon engaging a rim 78 inside the housing as shown in FIG. 6, for the present example.

The removable admission of the shank 5 of a tool having a pointed tip, for example the shank of a screwdriver having a cross-shaped blade, into the auxiliary insertion part 4 causes the tip of the shank to bear against the bottom edge of the hole 36 close to the end wall 33 of the conductive part in which the hole is made.

The application of a force on the portion of the shank 5 lying outside the block in a longitudinal direction towards the near end thereof produces a lever effect which moves the auxiliary insertion part 4 so that it can run along the path determined by its guide grooves.

When an electric wire 2 with an insulating covering is admitted into the orifice 71A so that its end comes into abutment against the end wall 33 of the conductive part 3 (see FIGS. 6 and 7), the auxiliary insertion part 4 presses against the covering 20 of the wire under drive from the shank 5 and level with the flared insulation-piercing inlet to the slit delimited by the edges 30.

The force exerted transversely on the shank 5 as multiplied by the lever effect, presses the covering 20 of the wire against the slicing edges of the insulation-piercing inlet by means of the pusher 40, thereby slicing through said covering transversely and reaching the core 21 of the wire.

The continued displacement of the auxiliary insertion part 4 under drive from the lever 5 causes pressure to be applied by the pusher 40 onto the covering 20 and therefore causes the core of the wire to penetrate between the edges 30 of the insulation-piercing slit into the zone where said edges are parallel and serve to retain the wire by clamping its conductive core 21 between said edges.

As mentioned above, the index 45 serves to verify that the auxiliary insertion part 4 has reached the end of its stroke and has come into abutment against the counter-abutment 76 in such a manner as to ensure that the wire insertion stroke is sufficient, said index 45 now appearing, in this case, beneath the counter-abutment 76 in the orifice 71A, as shown in FIG. 7, and latching beneath this abutment which holds it in place.

A second wire 2 may optionally be admitted into the orifice 71A by returning the auxiliary insertion part 4 backwardly to the position in which it is held by the notch 46 latching with the inside rim 78 of the housing 7, and again the end of the wire is put into contact with the end wall 33 of the conductive part 3 to prepare it for connection in the insulation-piercing slit of said part above the wire 2 which has already been connected thereto.

Connection takes place identically to the manner described above, with the covering of the second wire pressing against the covering of the first wire so that the first wire moves further between the parallel edges 30 of the insulation-piercing slit.

We claim:

1. An insulation-piercing connection arrangement for an electric wire, the arrangement comprising:

a conductive part having a slit having parallel edges and provided with an insulation-piercing inlet;

an insulating housing in which said conductive part is received, said housing being provided with a wire-passing opening for passing a wire parallel to the insulation-piercing slit, and with a shank-passing opening for passing a removable shank forming a lever for operating the connection arrangement;

an auxiliary wire-insertion part received in said housing and operable by said removable shank to press against one end of an electric wire to be connected in the slit, in such a manner that said wire end passes through said insulation-piercing inlet into said slit in a direction transverse to said wire until it occupies a position where the core of the wire is retained between the edges of the slit in electrical connection with said conductive part;

the arrangement including the improvements whereby:

said auxiliary insertion part is provided with an operating body having a shank-passing duct passing therethrough and said housing supports a fixed hole suitable for engaging a leading end of said removable shank when received in said shank-passing duct and acting as a thrust point therefor;

said auxiliary insertion part carries a pusher for pushing against said wire; and said housing and said auxiliary insertion part include an insertion part guide device comprising wheels disposed on said insertion part to co-operate with two complementary guide grooves in the housing in such a manner as to impart pseudocircular motion to said auxiliary insertion part under lateral pressure from said shank passing through said duct and pressing into said fixed hole;

thereby enabling said pusher to alternate, when a wire is connected by means of said arrangement, between an inclined, "admission", position in which said pusher allows an electric wire to be admitted through said opening over said insulation-piercing inlet, and an "insertion" position in which a pushing end of said pusher moves to beneath the level of said insulation-piercing inlet while pushing against said wire whose core is thus clamped between said parallel edges of said slit.

2. A connection arrangement according to claim 1, wherein said guide grooves associated with said auxiliary insertion part in said housing comprise a first slightly curved zone extending at least approximately parallel to said slit in said conductive part associated with said auxiliary insertion part, and a second slightly curved zone which opens out into said first zone and which is at a considerable slope relative to said first zone so as to accelerate tilting of said auxiliary part as it is displaced within said guide grooves.

3. A connection arrangement according to claim 2, wherein said guide grooves are positioned above the corresponding conductive part which includes a tubular portion constituted by a plane end wall and two parallel walls which extend perpendicularly thereto followed by two sloping walls whose respective outermost longitudinal margins constitute said edges of said slit, said first zones of said two complementary guide grooves being situated halfway between said slit and said end wall in such a manner as to enable said pusher and said shank-passing duct through said auxiliary insertion part to be positioned on either side of an axis running between those wheels of said guide device that slide in said first zones.

4. An connection arrangement according to claim 2, wherein said conductive part includes a sloping extension extending at a slope close to that of the second zone of said guide grooves above an end wall and beneath said guide grooves, said sloping extension being provided with said fixed hole for receiving the tip of said shank, and serving as a thrust point for the lever action of said shank, and wherein said shank-passing duct is disposed through said auxiliary insertion part in such a manner as to remain facing said hole, thereby enabling said removable shank to penetrate through said duct as far as said hole.

5. A connection arrangement according to claim 2, wherein said auxiliary insertion part includes an abutment for coming into abutment against a counter-abutment of said housing when said auxiliary part is in its insertion position.

6. A connection arrangement according to claim 5, wherein said auxiliary insertion part includes a snap-fastening index visible via said wire-passing opening when said auxiliary part is in its insertion position.

7. A connection arrangement according to claim 2, wherein said auxiliary insertion part includes a catch intended to cooperate with a rim of said housing in order to hold said auxiliary part in its admission position, said auxiliary part being released by pressure from said shank on said auxiliary part for the purposes of wire insertion.

* * * * *